US011174656B1

(12) United States Patent
Goedecke

(10) Patent No.: US 11,174,656 B1
(45) Date of Patent: Nov. 16, 2021

(54) FENCE CLIP APPARATUS AND METHOD

(71) Applicant: Bullet Fence Systems, LLC, Okmulgee, OK (US)

(72) Inventor: Ronald D. Goedecke, Okmulgee, OK (US)

(73) Assignee: Bullet Fence Systems, LLC, Okmulgee, OK (US)

( * ) Notice: Subject to any disclaimer, the term of this patent is extended or adjusted under 35 U.S.C. 154(b) by 149 days.

(21) Appl. No.: 16/814,723

(22) Filed: Mar. 10, 2020

Related U.S. Application Data

(60) Provisional application No. 62/816,342, filed on Mar. 11, 2019.

(51) Int. Cl.
*E04H 17/10* (2006.01)
*E04H 17/26* (2006.01)

(52) U.S. Cl.
CPC ..... *E04H 17/10* (2013.01); *E04H 17/268* (2013.01)

(58) Field of Classification Search
CPC ..... E04H 17/10; E04H 17/24; E04H 17/124; E04H 17/26; E04H 17/261; E04H 17/268
See application file for complete search history.

(56) References Cited

U.S. PATENT DOCUMENTS 356,638 A * 1/1887 Haag ..... E04H 17/268 140/57
387,691 A * 8/1888 Newbanks et al. ... E04H 17/268 140/57
571,150 A * 11/1896 Conover ..... E04H 17/10 256/39
721,434 A 2/1903 Edebum
894,301 A 7/1908 Wharton
900,099 A 10/1908 Hurd
1,765,651 A 6/1923 Bryant
2,126,225 A 8/1938 Simons
2,212,455 A 8/1940 Reed
2,242,427 A 2/1941 Heanue
2,622,634 A 12/1952 Hill
2,722,006 A 11/1955 Ingram
2,806,220 A 9/1957 Motl
2,923,008 A * 2/1960 Ingram ..... E04H 17/268 29/243.56
3,031,170 A * 4/1962 Ingram ..... E04H 17/268 256/57
3,648,982 A 3/1972 Sabel et al.
3,772,837 A 11/1973 Hunt
(Continued)

FOREIGN PATENT DOCUMENTS

GB 201361 8/1932
GB 834862 8/1958
(Continued)

OTHER PUBLICATIONS

PCT/US2016/064019; International Search Report and Written Opinion; dated Feb. 7, 2016; Applicant: Bullet Fence Systems, LLC; Published in: WO.
(Continued)

*Primary Examiner* — Jonathan P Masinick
(74) *Attorney, Agent, or Firm* — Dennis D. Brown; Brown Patent Law, P.L.L.C.

(57) ABSTRACT

An apparatus and method for clipping a fence wire on a T-post.

17 Claims, 6 Drawing Sheets

(56) References Cited

U.S. PATENT DOCUMENTS

| | | | | |
|---|---|---|---|---|
| 3,945,238 | A * | 3/1976 | Eckert | B25B 27/146 72/409.03 |
| 4,074,893 | A | 2/1978 | Coltrin | |
| 4,078,772 | A | 3/1978 | Carbone | |
| 4,140,414 | A | 2/1979 | Buttgereit | |
| 5,020,355 | A * | 6/1991 | Payne | B25B 27/146 140/57 |
| 5,026,028 | A | 6/1991 | Ooi et al. | |
| 5,593,143 | A | 1/1997 | Ferrarin | |
| 5,938,099 | A | 8/1999 | Ciccarelli | |
| 5,971,365 | A | 10/1999 | Pigott et al. | |
| 6,044,872 | A | 4/2000 | Stephens | |
| 6,386,519 | B1 | 5/2002 | Priefert | |
| 6,725,535 | B2 * | 4/2004 | Edson | B25B 27/146 221/238 |
| 7,048,259 | B2 | 5/2006 | Quaintance et al. | |
| 7,121,530 | B1 | 10/2006 | Preta | |
| 7,347,412 | B1 | 3/2008 | Zhu | |
| 7,784,744 | B2 | 8/2010 | Becker | |
| 7,788,785 | B2 | 9/2010 | Platt | |
| 8,632,056 | B1 | 1/2014 | Roberts et al. | |
| 10,781,007 | B2 * | 9/2020 | Seesing | E04H 17/268 |
| 2005/0229996 | A1 * | 10/2005 | Lile, Jr. | B21F 15/00 140/57 |
| 2006/0033093 | A1 | 2/2006 | Lo | |
| 2006/0076072 | A1 * | 4/2006 | Lile | E04H 17/268 140/57 |
| 2006/0243340 | A1 * | 11/2006 | Wheeler | B21F 15/00 140/57 |
| 2008/0029748 | A1 | 2/2008 | Ford | |
| 2008/0061279 | A1 | 3/2008 | Sullivan | |
| 2014/0131647 | A1 | 5/2014 | Dillon | |

FOREIGN PATENT DOCUMENTS

| | | |
|---|---|---|
| GB | 2307256 | 5/1997 |
| GB | 2523343 | 8/2015 |
| WO | 9630656 | 10/1996 |

OTHER PUBLICATIONS

Internet Printout; Simple Connector; 440 Ranch Fence by Ameristar; US.

Internet Printout; Kencove Wedge-LOC; Kencove Farm Fence Supplies; US.

Internet Printout; Speed Brace; www.orshelnfarmhome.com; US.

Internet Printout; T-Post Smart Brace; Dillon Fencing; US.

Internet Printout; No Weld Pipe Connectors; No Weld Products, Inc.; 2015; US.

* cited by examiner

FENCE CLIP APPARATUS AND METHOD

RELATED CASE

This application claims the benefit of U.S. Provisional Patent Application Ser. No. 62/816,342 filed on Mar. 11, 2019 and incorporates said provisional application by reference into this document as if fully set out at this point.

FIELD OF THE INVENTION

The present invention relates to apparatuses and methods for attaching fence wires to fence posts.

BACKGROUND OF THE INVENTION

Wire fences formed of one or more, typically at least two, lengths of fence wire attached to a series of vertical metal T-posts are commonly used in the livestock industry and for other purposes. Heretofore, when constructing such fences, it has been necessary to carry a pouch or package of loose, partially bent wire clips which become tangled and are difficult to separate and use. In addition, when connecting the horizontal fence wires to the T-posts, it has been necessary for the worker to lift each wire to its required elevation on the post, place a preformed clip around the back of the post so that the preformed ends of the clip rest on top of the wire, facing the worker, and then bend the ends of the pre-formed clip around the wire by hand or using pliers or similar tools. This process is very tedious, inefficient, and time consuming.

Thus, a need exists for an improved apparatus and method for clipping fence wires to T-posts. The improved apparatus and method will preferably (i) be much simpler to use, (ii) use clips which are less costly to manufacture, (iii) eliminate clip tangling problems, and (iv) significantly reduce construction times and labor costs.

SUMMARY OF THE INVENTION

The present invention alleviates the problems and satisfies the needs mentioned above.

In one aspect, there is provided an apparatus for attaching a fence wire on a T-post. The apparatus preferably comprises: (a) a body assembly comprising a lower plate, an upper plate positioned above the lower plate, and a slide plate which is slideably retained between the lower plate and the upper plate for forward and rearward sliding movement; (b) the lower plate having a T-post receiving notch which extends rearwardly into a forward end of the bottom plate and is configured to receive a rearwardly projecting cross-sectional segment of a T-Post, the lower plate also having left and right forward edges located on opposite left and right sides of the T-post receiving notch; (c) the upper plate having a receiving slot which extends rearwardly into a forward end of the upper plate and is configured to receive the rearwardly projecting cross-sectional segment of the T-post such that the forward end of the upper plate will substantially abut a forward cross-sectional segment of the T-post which is perpendicular to the rearwardly projecting cross-sectional segment; (d) a V-clip opening provided through the upper plate to deliver a V-clip therethrough onto an upper surface of the lower plate; (e) the slide plate having a V-clip receiving notch which extends rearwardly into a forward end of the slide plate and is configured to receive the V-clip resting on the upper surface of the lower plate and to push the V-clip forward as the slide plate is caused to slide forwardly between the lower and the upper plates; and (f) a bending lever which is pivotably positioned (in the body assembly and includes left and right forward contacting structures to contact and bend a pair of projecting left and right legs of the V-clip as the left and right forward contacting structures of the bending lever are pivoted downward.

In another aspect, the apparatus preferably further comprises a pair of left and right wire grasping hooks on opposite sides of the body assembly, each of the wire grasping hooks preferably having (i) a first portion which extends forwardly from a forward end of the body assembly and (ii) a second portion which extends downwardly from a forward end of the first portion. Each of the left and right wire grasping hooks preferably has an upside down L shape.

In another aspect, the left and right forward edges of the lower plate preferably extend forwardly beyond the forward end of the upper plate such that the left and right forward edges of the lower plate will extend forwardly beyond a forward face of the forward cross-sectional segment of the T-post.

In another aspect, the apparatus preferably also comprises a V-clip magazine on the body assembly above, and having a lower end in communication with, the V-clip opening provided through the upper plate. In addition, the V-clip magazine preferably has a vertical stack of flat V-clips therein.

In the method of the present invention, the inventive apparatus is preferably used to clip a fence wire to a T-post using a flat V-clip, the flat V-clip preferably comprising a closed rearward end and an opposing pair of legs which diverge outwardly as they extend forwardly from the closed rearward end.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
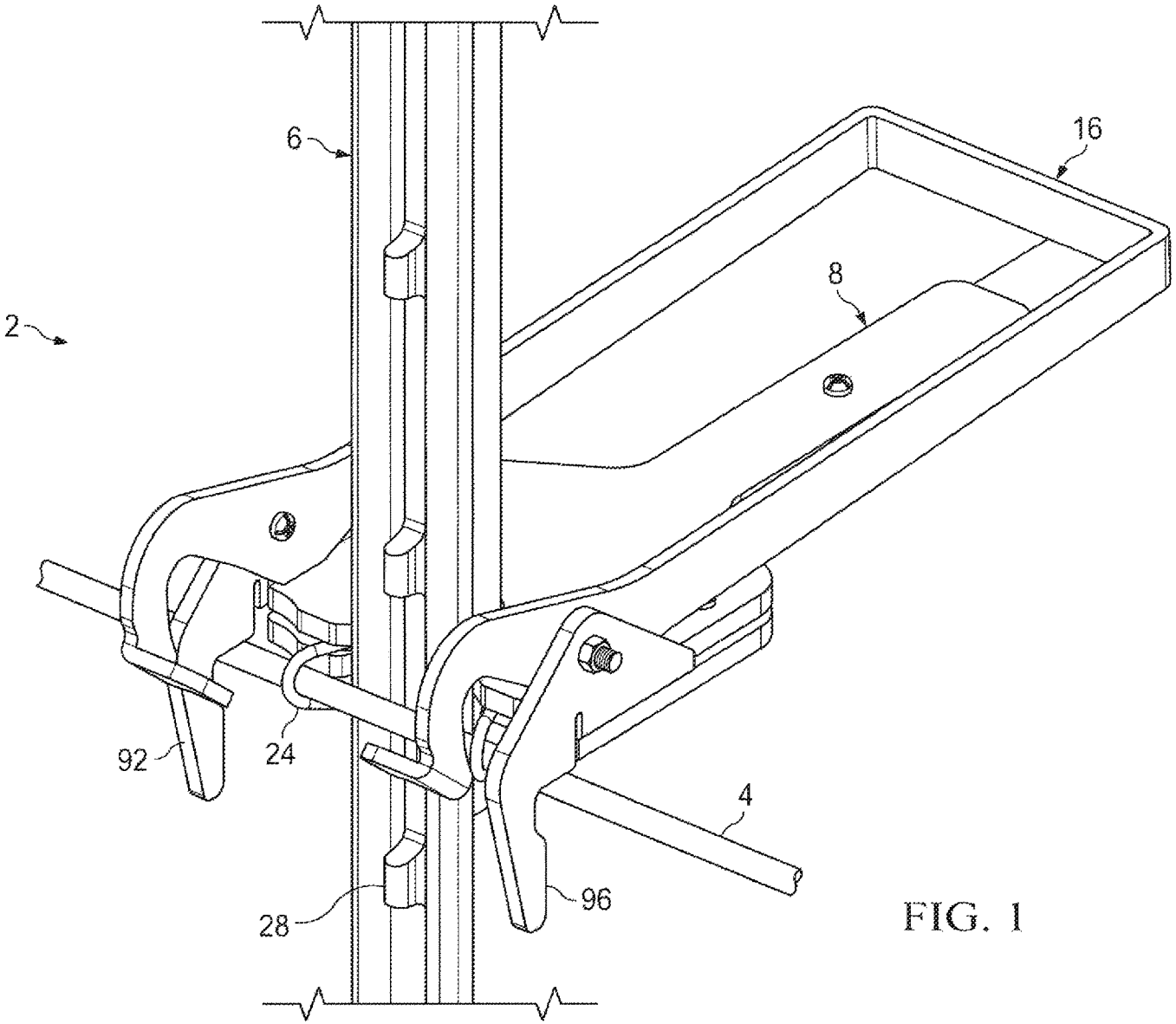
FIG. 1 is a perspective view of an embodiment 2 of the inventive apparatus for clipping a fence wire 4 to a T-post 6.
Figure 2:
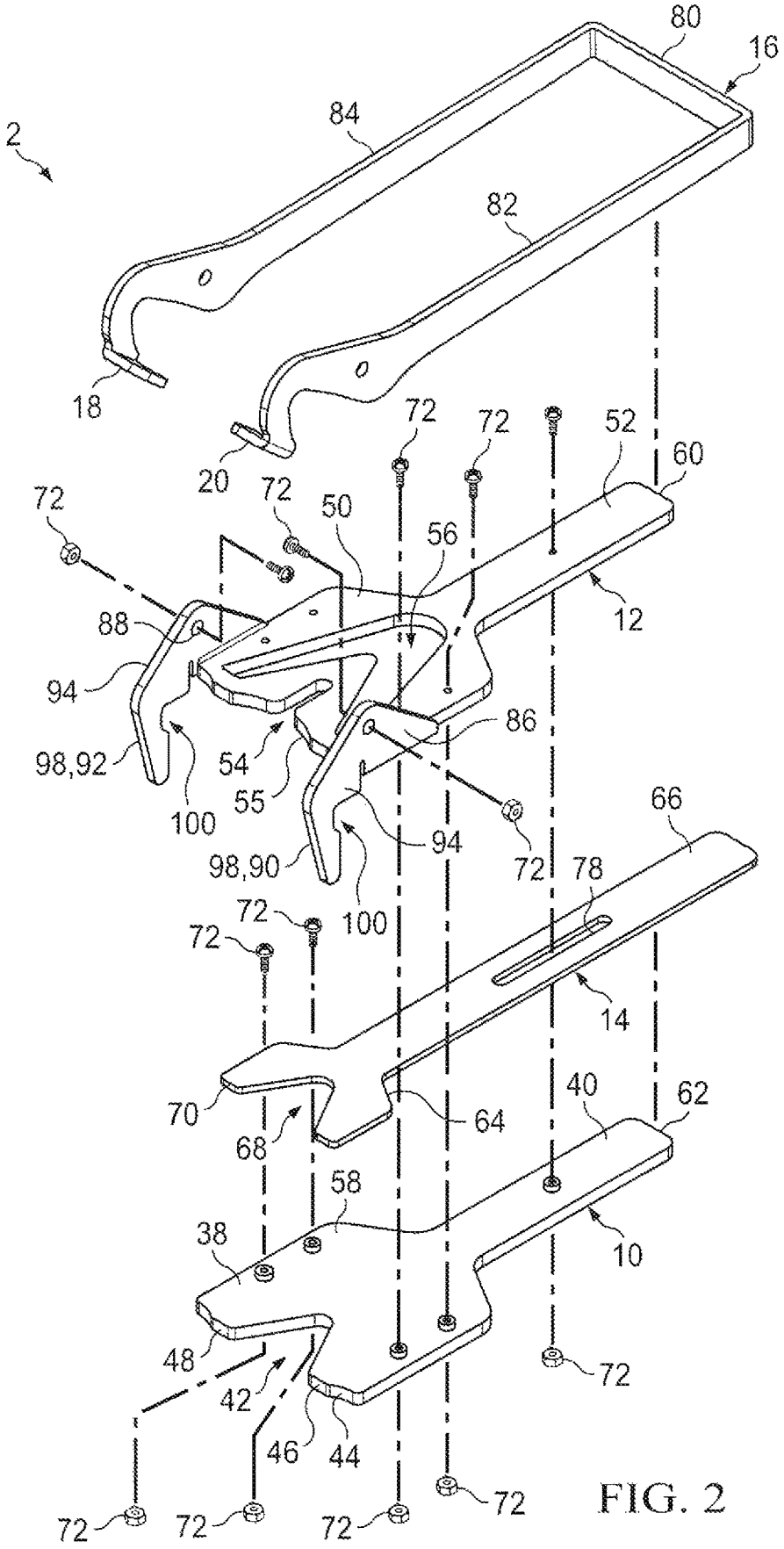
FIG. 2 is an exploded view of the inventive clipping apparatus 2.

An embodiment 2 of the inventive apparatus for clipping a fence wire 4 on an upwardly extending T-post 6 is shown in FIGS. 1-5. The inventive clipping apparatus 2 preferably comprises: (i) a body assembly 8 comprising a lower plate 10, an upper plate 12 positioned above the lower plate 10, and a slide plate 14 which is slideably retained between the lower plate 10 and the upper plate 12 for forward and rearward sliding movement; (ii) a clip bending lever 16 which is pivotably positioned on the body assembly 8 and includes left and right forward clip-contacting structures 18 and 20; (iii) a V-clip feed magazine 22 which is removably positionable on the body assembly 8; and (iv) a supply (i.e., a vertical stack) of flat V-clips 24 in the V-clip magazine 22.

Figure 3:
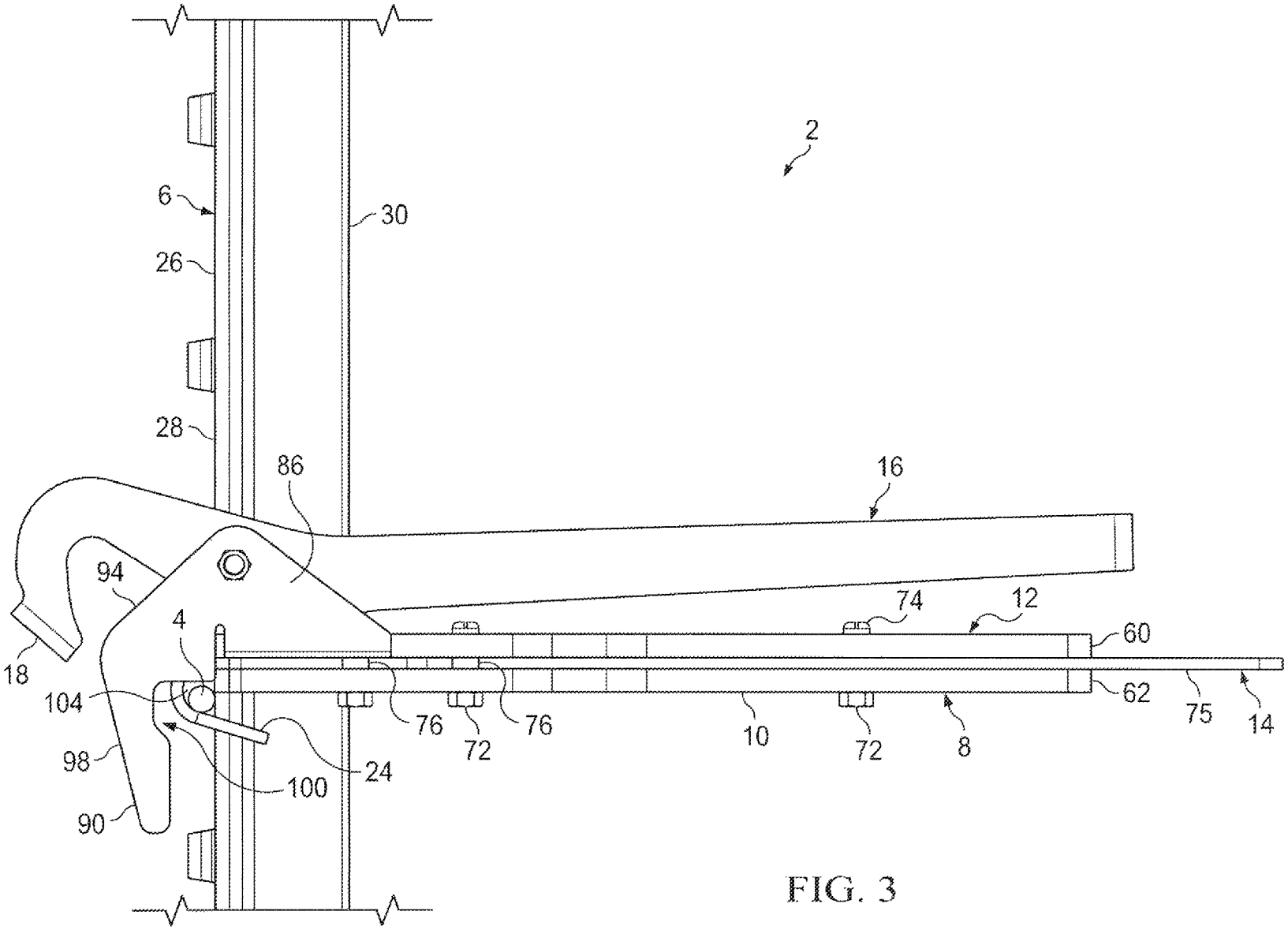
FIG. 3 is an elevational side view of the inventive clipping apparatus 2.
Figure 4:
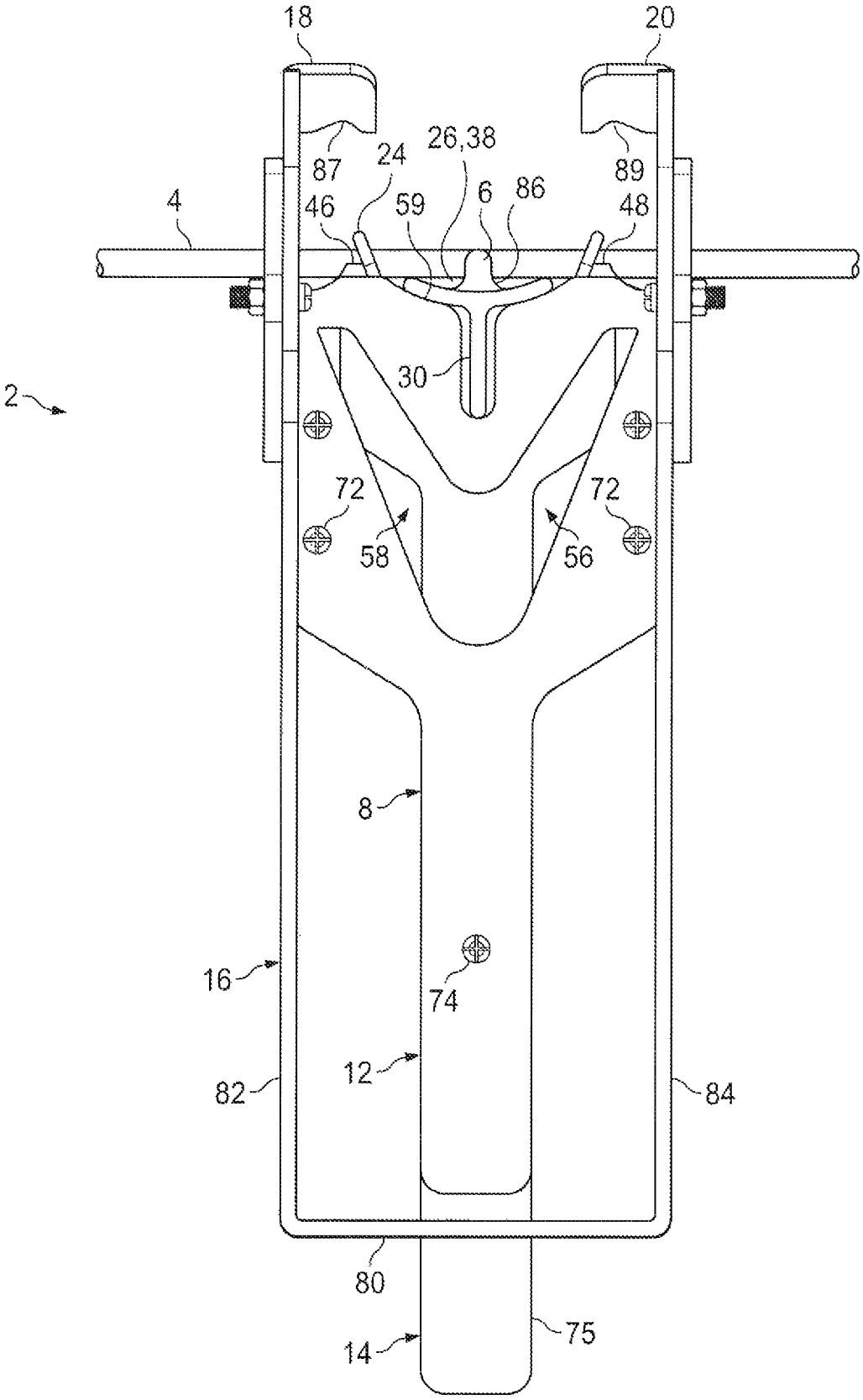
FIG. 4 is a plan view of the inventive clipping apparatus 2.
Figure 5:
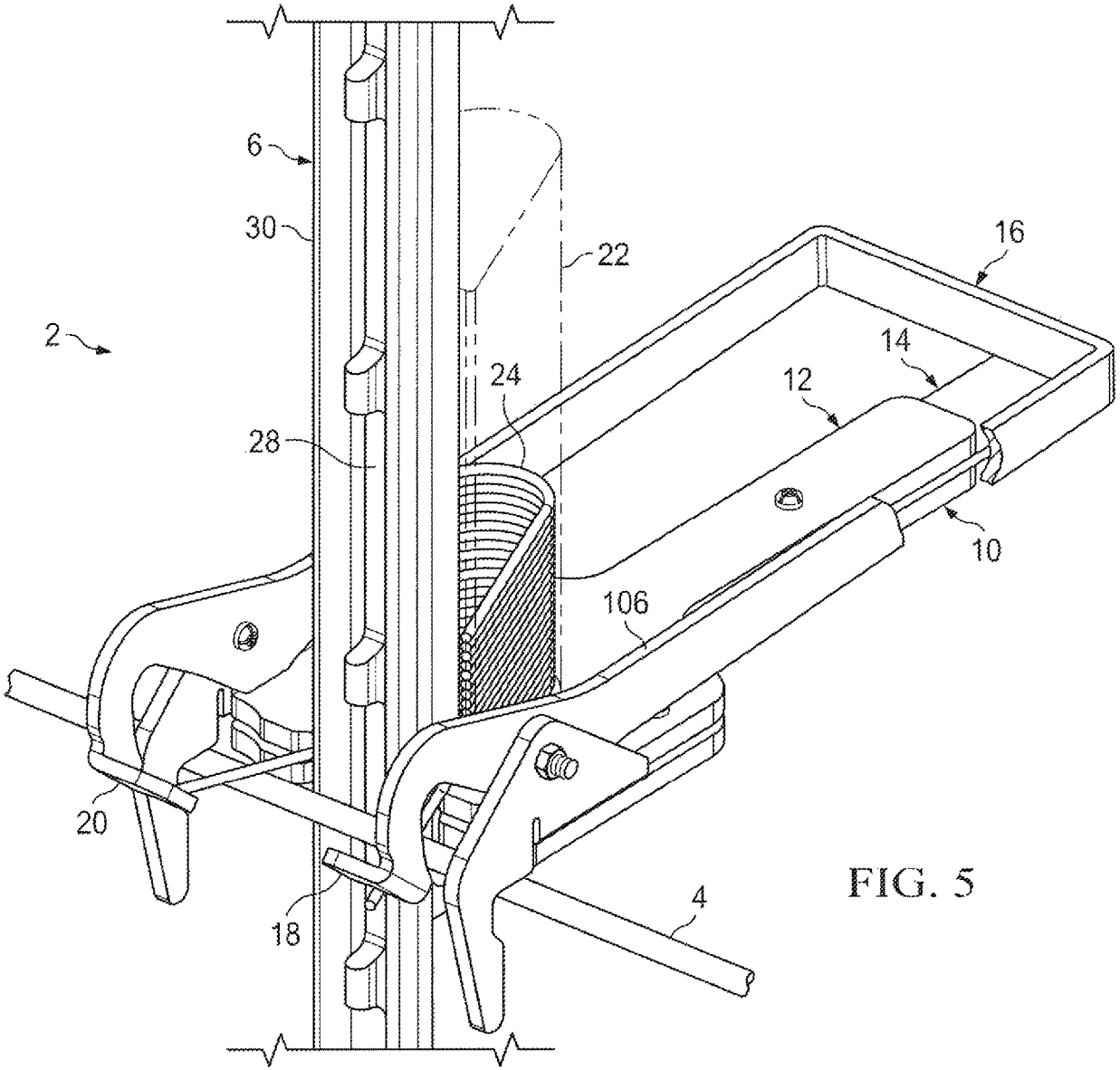
FIG. 5 is a perspective view of the inventive clipping apparatus 2 having a V-clip magazine 22 attached thereon.

Although other types of posts could alternatively be used, a common type of T-post 6 to which the fence wire 4 will be attached will typically have a cross-sectional T shape as illustrated in FIGS. 3 and 4 comprising: (a) a forward cross-sectional segment 26 having a forward face 28 across which the fence wire 4 will be attached and (b) a rearwardly projecting cross-sectional segment 30 which is substantially perpendicular to and extends rearwardly from a central portion of the forward cross-sectional segment 26.

Figure 6:
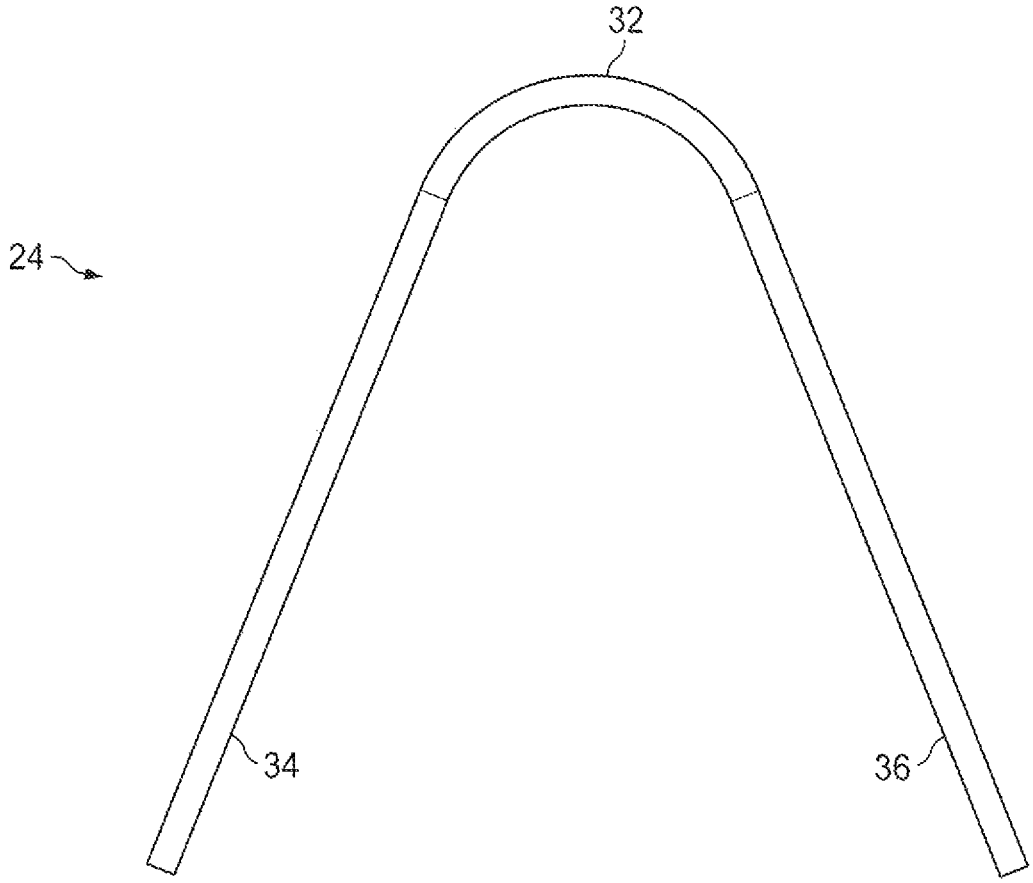
FIG. 6 is a top view of an embodiment 24 of a flat V-clip preferred for use in the inventive clipping apparatus 2.

Although clips having other V-shapes could also alternatively be used, each of the flat V-clips 24 used in the inventive clipping apparatus 2 for attaching the fence wire 4 across the forward face 28 of the T-post 6 will preferably be a flat wire structure as illustrated in FIG. 6 comprising a closed rearward end 32 and an opposing pair of left and right legs 34 and 36 which diverge outwardly as they extend forwardly from the closed rearward end 32. The closed rearward end 32 of the flat V-clip 24 is preferably rounded as illustrated in FIG. 6, but could alternatively have more of a pointed, squared, or other shape. The forwardly projecting left and right legs 34 and 36 of the V-clip 24 are preferably substantially straight but could alternatively be curved or have other shapes. The forwardly projecting legs 34 and 36 of the V-clip 24 preferably have a length and preferably diverge outwardly from each other at an angle such that, when the V-clip 24 is placed in a clipping position on the T-post 6 with the rearward end of the rearwardly projecting cross-sectional segment 30 of the T-post 6 positioned within and in contact with the closed rearward end 32 of the flat V-clip 24, the left and right legs 34 and 36 of the flat V-clip 24 will project forwardly on opposite left and right sides of the T-post 6 past the forward face 28 of the T-post 6 and over and across the top of the fence wire 4.

The lower plate 10 of the body assembly 8 preferably comprises: a wide forward portion 38; an elongate panhandle portion 40 which extends rearwardly from the forward portion 38; a T-post receiving notch 42 which extends rearwardly into the forward end 44 of the forward portion 38 of the lower plate 10; and left and right forward edges 46 and 48 located on opposite left and right sides of the T-post receiving notch 42. The T-post receiving notch 42 preferably has a V-shape similar to the shape of the flat V-clip 24 and is preferably sized and configured to receive the rearwardly projecting cross-sectional segment 30 of the T-Post 6 such that, when the inventive clipping apparatus 2 is moved forwardly to fully receive the T-post 6, the left and right forward edges 46 and 48 of the lower plate 10 will extend on the opposite left and right sides of the T-post 6 beyond the forward face 28 of the forward cross-sectional segment 26 of the T-post 6. The V-shaped profile of the receiving notch 42 also allows the subsequent release of the tied V-clip 24 by pulling the apparatus 2 rearwardly so that the V-clip 24 slides forwardly off of the upper surface of lower plate 10 and into the correspondingly shaped open area of the notch 42.

The upper plate 12 of the body assembly 8 preferably comprises: a wide forward portion 50; an elongate panhandle portion 52 which extends rearwardly from the forward portion 50; a T-post receiving slot 54 which extends rearwardly into the forward end 55 of the forward portion 50 of the upper plate 12; and a V-clip opening 56 provided through the top of wide forward portion 50 of the upper plate 12 for delivering a flat V-clip 24 therethrough onto the upper surface 58 of the wide forward portion 38 of the lower plate 10. The V-clip opening 56 preferably has a V-shape corresponding to the shape of the V-clip 24. The forward receiving slot 54 of the upper plate 12 has a length and width, and is otherwise configured, such that when the rearwardly projecting cross-sectional segment 30 of the T-post 6 is fully received in the receiving slot 54 of the upper plate 12, the forward end 55 of the upper plate 12 will preferably abut or substantially abut the rearward side 59 of the forward cross-sectional segment 26 of the T-post 6.

The length of the rearward panhandle portion 52 of the upper plate 12 is preferably the same as the length of the rearward panhandle portion 40 of the lower plate 10 so that when the upper plate 12 and the lower plate 10 are secured together in the body assembly 8, the rearward end 60 of the upper plate 12 is even with or substantially even with the rearward end 62 of the lower plate 10. However, as will be discussed more fully below, the left and right forward edges 46 and 48 of the lower plate 10 preferably extend forwardly beyond the forward end 55 of the upper plate 12 so that the forward edges 46 and 48 of the lower plate 10 will provide bending surfaces for bending the forwardly projecting legs 34 and 36 of the V-clip 24.

The slide plate 14 of the body assembly 8 preferably comprises: a wide forward portion 64; an elongate panhandle portion 66 which extends rearwardly from the forward portion 64; and a V-clip receiving notch 68 which extends rearwardly into the forward end 70 of the forward portion 64 of the slide plate 14. The V-clip receiving notch 68 preferably has a V-shape corresponding to the shape of the flat V-clip 24 and is configured to receive the rearward end 32 a flat V-clip 24 resting on the upper surface 58 of the wide forward portion 38 of the lower plate 10 so that, when the user pushes the slide plate 14 to cause the slide plate 14 to slide forwardly between the lower and the upper plates 10 and 12, the slide plate engages the V-clip 24 and moves the V-clip forwardly to a clipping position.

The lower and upper plates 10 and 12 of the body assembly 8 are connected together by (i) a plurality of side bolts or pins 72 which extend perpendicularly through the outer portions of the wide forward portions 38 and 50 of the lower and upper plates 10 and 12 and (ii) a bolt or pin 74 which extends perpendicularly through the rearward panhandle portions 40 and 52 of the lower and upper plates 10 and 12. The bolts or pins 72 and 74 preferably extend through washers or other spacers 76 positioned between the lower and upper plates 10 and 12 to provide sufficient space between the plates 10 and 12 for receiving and accommodating the forward and rearward sliding movement of the slide plate 14. The rearward bolt or pin 74 extends through an elongate central slot 78 provided through the rearward panhandle portion 66 of the slide plate 14 which allows, but limits, the longitudinal sliding movement of the slide plate 14 between a rearward position for receiving a V-clip 24 and a forward position which places the V-clip in a clipping position. At the same time, the forward bolts or pins 72 are positioned closely outside of the wide forward portion 64 of the slide plate 14 to guide the slide plate 14 so that the slide plate 14 moves forwardly and rearwardly along a substantially linear path. A rearward portion 75 of the slide plate 14 extends beyond the rearward ends 60 and 62 of the upper and lower plates 12 and 10 for pushing the slide plate 14 forwardly and pulling the slide plate 14 rearwardly during use.

Although other types of bending levers could alternatively be used, the clip bending lever 16 used in the inventive clipping apparatus 2 preferably has squared U shape comprising: a rearward, lateral gripping handle 80; an opposing pair of left and right bending arms 82 and 84 which extend forwardly from the rearward handle 80; and an opposing pair of left and right forward clip-contacting structures 18 and 20, as mentioned above, which extend inwardly toward each other from the forward ends of the left and right bending arms 82 and 84. The left and right bending arms 82 and 84 are pivotably attached to the body assembly 8, for simultaneous upward and downward pivoting movement, by a pair of opposing left and right pivot ears 86 and 88 which extend upwardly from the sides of the wide forward portion 50 of the upper plate 12.

The opposing left and right forward clip-contacting structures 18 and 20 of the bending lever 16 preferably have notched or otherwise contoured lower edges 87 and 89 for contacting and preventing lateral movement of the forwardly extending legs 34 and 36 of the V-clip 24 as the clip-contacting structures 18 and 20 are pivoted downwardly to bend the legs 34 and 36 of the V-clip 24. The clip-contacting structures 18 and 20 most preferably comprise opposing plates or tabs which angle rearwardly as they extend downwardly on the forward ends of the bending arms 82 and 84.

The body assembly 8 of the inventive clipping apparatus 2 preferably also comprises a pair of left and right wire grasping hooks 90 and 92 which extend forwardly form opposite sides of the body assembly 8. The grasping hooks 90 and 92 are preferably attached to the upper plate 12. Each of the wire grasping hooks 90 and 92 preferably comprises: (i) a first portion 94 which extends forwardly from the forward end of the body assembly 8 and (ii) a second portion 98 which extends downwardly from a forward end of the first portion 94. Each of the left and right wire grasping hooks 90 and 92 preferably has an upside down L shape. The second portion 98 of each of the wire grasping hooks 90 and 92 preferably also includes an inner slot 100 which extends forwardly into the inner edge of the downwardly extending second portion 98 of the hook 90 or 92. The upper end 104 of each of the inner slots 100 of the wire grasping hooks 90 and 92 is preferably located at substantially the same elevation as (i.e., is preferably neither higher nor lower than) the left and right forward edges 46 and 48 of the lower plate 10.

The V-clip magazine 22 is preferably an elongate shell or container structure having a cross-sectional shape which corresponds to the shape of the flat V-clips 24 so that a stack of the flat V-clips 22 can be placed and held in the magazine 22 and fed downwardly for use. A spring loaded tab or other biasing mechanism (not shown) is preferably provided in the upper portion of the magazine 22 to apply a constant downward feeding pressure against the upper end the vertical stack of V-clips 22. The magazine 22 has a lower end 106 which can be removably clipped or otherwise held on top of the upper plate 12, in communication with V-clip opening 56, for feeding the flat V-clips downwardly through the V-clip opening 56 and onto the upper surface 58 of the lower plate 10.

When using the inventive clipping apparatus 2 in accordance with the method of the present invention to attach a fence wire 4 on a T-post 6, a flat V-clip 24 is delivered by hand, or automatically by a clip magazine 22, downwardly through the V-clip opening 56 of the upper plate 12 onto the upper surface 58 of the lower plate 10. The user then slides the slide plate 14 forwardly to push the V-Clip 24 forward between the upper plate 12 and the lower plate 10 to a clipping stop position. Next, the user approaches the rearward side of the T-post 6 (i.e., the side of the post 6 opposite the fence wire 4) and grasps the fence wire 4 on opposite left and right sides of the T-post 6 with the left and right wire grasping hooks 90 and 92 of the inventive apparatus 2. The user then moves the fence wire 4 (i.e., pushes the fence wire 4 downwardly or pulls the fence wire 4 upwardly as may be necessary) to a desired elevational location across the forward face 28 of the forward cross-sectional segment 26 of the T-post 6 with the legs 34 and 36 of the flat V-clip 24 extending forwardly over the fence wire 4.

Next, the user pivots the rearward gripping handle 80 of the bending lever 16 upwardly with respect to the assembly body 8 in order to pivot the left and right forward contacting structures 18 and 20 of the bending lever 16 downwardly into contact with the legs 34 and 36 of the flat V-clip 24 so that the continued downward pivoting movement of the forward contacting structures 18 and 20 bends the legs 34 and 36 of the V-clip 24 downwardly around the fence wire 4. This in turn also pulls the fence wire 4 and the body assembly 8 of the apparatus 2 toward each other as needed so that (a) the fence wire is in contact with the forward face 28 of the T-post 6, (b) the rearwardly projecting cross-sectional segment 30 of the T-post 6 is positioned in the T-post receiving notch 42 of the lower plate 10 and in the receiving slot 54 of the upper plate 12, (c) the forward end 55 of the upper plate 12 is in abutment or substantially in abutment with the rearward side 58 of the forward cross-sectional segment 26 of the T-post 6, and (d) the left and right forward edges 46 and 48 of the lower plate 10 are positioned on top of and in contact with the fence wire 4 so that the left and right forward edges 46 and 48 of the lower plate 10 provide bending surfaces for the legs 34 and 36 of the flat V-clip 24.

Next, the clipping apparatus 2 is pulled rearwardly away from the T-post 6 so that the V-clip slides forwardly off of the upper surface 58 of the lower plate 10, thereby placing the left and right legs 34 and 36 of the V-clip 24 directly on top of the fence wire 4. The user can then either pull the apparatus 2 away from the T-post 6 entirely, or further tighten the attachment of the fence wire 4 to the T-post 6 by operating the bending lever 16 to pivot the left and right forward contacting structures 18 and 20 of the bending lever 16 downwardly in order to further bend the legs 34 and 36 of the V-clip 24 around the fence wire 4.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within this invention as defined by the claims.

What is claimed is:

1. An apparatus for attaching a fence wire on a T-post comprising:

a body assembly comprising a lower plate, an upper plate positioned above the lower plate, and a slide plate which is slideably retained between the lower plate and the upper plate for forward and rearward sliding movement;

the lower plate having a T-post receiving notch which extends rearwardly into a forward end of the lower plate and is configured to receive a rearwardly projecting cross-sectional segment of a T-Post, the lower plate also having left and right forward edges located on opposite left and right sides of the T-post receiving notch;

the upper plate having a receiving slot which extends rearwardly into a forward end of the upper plate and is configured to receive the rearwardly projecting cross-sectional segment of the T-post such that the forward end of the upper plate will substantially abut a forward cross-sectional segment of the T-post which is perpendicular to the rearwardly projecting cross-sectional segment, a V-clip opening provided through the upper plate to deliver a V-clip therethrough onto an upper surface of the lower plate;

the slide plate having a V-clip receiving notch which extends rearwardly into a forward end of the slide plate and is configured to receive the V-clip resting on the upper surface of the lower plate and to push the V-clip forward as the slide plate is caused to slide forwardly between the lower and the upper plates; and a bending lever which is pivotably positioned on the body assembly and includes left and right forward contacting structures to contact and bend a pair of projecting left and right legs of the V-clip as the left and right forward contacting structures of the bending lever are pivoted downward.

2. The apparatus of claim 1 wherein the left and right forward edges of the lower plate extend forwardly beyond the forward end of the upper plate such that the left and right forward edges of the lower plate will extend forwardly beyond a forward face of the forward cross-sectional segment of the T-post.

3. The apparatus of claim 1 further comprising a pair of left and right wire grasping hooks on opposite sides of the body assembly, each of the wire grasping hooks having (i) a first portion which extends forwardly from a forward end of the body assembly and (ii) a second portion which extends downwardly from a forward end of the first portion.

4. The apparatus of claim 3 wherein the left and right wire grasping hooks have an upside down L shape.

5. The apparatus of claim 4 wherein the second portion of each of the wire grasping hooks has an inner slot therein.

6. The apparatus of claim 5 wherein the inner slot of each of the wire grasping books has an upper end which is neither higher nor lower than the left and right forward edges of the lower plate.

7. The apparatus of claim 1 wherein the left and right forward contacting structures of the bending lever have lower contoured edges which contact the forwardly projecting left and right legs of the V-clip.

8. The apparatus of claim 7 wherein the left and right forward contacting structures of the bending lever comprise opposing plates or tabs which extend laterally inward toward each other.

9. The apparatus of claim 1 wherein:

the lower plate of the body assembly has a rearwardly extending panhandle portion having a rearward end;

the upper plate of the body assembly has a rearwardly extending panhandle portion having a rearward end;

the rearward ends of the rearwardly extending panhandle portions of the lower and upper plates of the body assembly are substantially even; and the slide plate of the body assembly has a rearwardly extending panhandle portion having a rearward end which extends rearwardly beyond the rearward ends of the rearwardly extending panhandle portions of the lower and upper plates.

10. The apparatus of claim 9 wherein a longitudinal slot is provided through the rearwardly extending panhandle portion of the slide plate and wherein a bolt or pin connecting the rearwardly extending panhandle portions of the lower and upper plates extends through the longitudinal slot provided through the rearwardly extending panhandle portion of the slide plate.

11. The apparatus of claim 1 further comprising a V-clip magazine on the body assembly above, and having a lower end in communication with, the V-clip opening provided through the upper plate.

12. The apparatus of claim 1 wherein the V-clip magazine is removably positioned on the body assembly.

13. The apparatus of claim 11 further comprising a vertical stack of flat V-clips in the V-clip magazine.

14. A method of attaching a fence wire on a T-post using the apparatus of claim 3, the method comprising the steps of:

a) delivering a flat V-clip through the V-clip opening of the upper plate onto the upper surface of the lower plate, the flat V-clip comprising a closed rearward end and an opposing pair of legs which diverge outwardly as they extend forwardly from the closed rearward end;

b) sliding the slide plate forwardly to push the flat V-clip forward to a clipping position;

c) grasping the fence wire on opposite left and right sides of the T-post with the left and right grasping hooks and positioning the fence wire at a desired elevational location across a forward face of the forward cross-sectional segment of the T-post with the legs of the flat V-clip extending over the fence wire;

d) operating the bending lever to pivot the left and right forward contacting structures of the bending lever downward into contact with the legs of the flat V-clip so that the continued downward pivoting movement of the forward contacting structures bends the legs of the flat V-clip downward around the fence wire, which also moves the fence wire and the body assembly toward each other to establish a relationship wherein (i) the fence wire is positioned on the forward face of the T-post, (ii) the rearwardly projecting cross-sectional segment of the T-post is positioned in the T-post receiving notch of the lower plate and in the receiving slot of the upper plate, and (iii) the forward end of the upper plate is substantially in abutment with a rearward side of the forward cross-sectional segment of the T-post.

15. The method of claim 14 wherein:

the left and right forward edges of the lower plate of the apparatus extend forwardly beyond the forward end of the upper plate and in the relationship established in step (d), the left and right forward edges of the lower plate are positioned on top of and in contact with the fence wire so that the left and right forward edges of the lower plate provide bending surfaces for the legs of the flat V-clip.

16. The method of claim 14 further comprising the steps, after step (d), of:

e) moving the body assembly of the apparatus rearwardly so that the left and right legs of the V-clip are positioned on top of the fence wire and f) operating the bending lever to pivot the left and right forward contacting structures of the bending lever downward to further bend the legs of the flat V-clip around the fence wire.

17. The method of claim 14 wherein the flat V-clip is delivered through the V-clip opening of the upper plate in step (a) using a V-clip magazine positioned on the body assembly, the V-clip magazine having a lower end in communication with the V-clip opening of the upper plate.

* * * * *